US005794180A

United States Patent [19]

McCree

[11] Patent Number: 5,794,180

[45] Date of Patent: Aug. 11, 1998

[54] SIGNAL QUANTIZER WHEREIN AVERAGE LEVEL REPLACES SUBFRAME STEADY-STATE LEVELS

[75] Inventor: Alan V. McCree, Dallas, Tex.

[73] Assignee: Texas Instruments Incorporated, Dallas, Tex.

[21] Appl. No.: 640,292

[22] Filed: Apr. 30, 1996

[51] Int. Cl.[6] ..... G10L 9/18

[52] U.S. Cl. ..... 704/212; 704/230; 704/228; 704/265

[58] Field of Search ..... 395/2.39, 2.2, 395/2.74, 2.21, 2.12, 2.38, 2.94, 2.34, 2.3, 2.92; 704/200, 201, 228, 227, 226

[56] References Cited

U.S. PATENT DOCUMENTS 4,392,018 7/1983 Fette ..... 395/2.74

4,701,955 10/1987 Taguchi ..... 395/2.32

5,471,558 11/1995 Tsutsui ..... 395/2.28

*Primary Examiner*—David R. Hudspeth

*Assistant Examiner*—Donald L. Storm

*Attorney, Agent, or Firm*—Robert L. Troike; Wade James Brady, III; Richard L. Donaldson

[57] ABSTRACT

A quantizer and a low bit rate communication system using the quantizer is described. The quantizer includes a 3-bit and 5-bit encoder where the 3-bit encoder provides the encoded gain for a first half of a sampled frame of speech and the second encoder for the second half of the frame of speech. A special 3-bit code is provided when a steady state is determined by comparing the 3-bit code and neighboring 5-bit codes. The decoder in the system when detecting the special code provides an average of the 5-bit codes if the decoded 5-bit code is within 5 dB of the previous 5-bit code.

22 Claims, 4 Drawing Sheets

SIGNAL QUANTIZER WHEREIN AVERAGE LEVEL REPLACES SUBFRAME STEADY-STATE LEVELS

This invention was made with Government support under contract awarded by the Department of Defense. The Government has certain rights in this invention.

TECHNICAL FIELD OF THE INVENTION

This invention relates to a quantizer and more particularly to an improved signal quantizer suitable for use in speech coding.

1. Related Application

Application Ser. No. 08/218,003 entitled "Mixed Excitation Linear Prediction with Fractional Pitch" of A McCree filed Mar. 3, 1994 now abandoned and a continuation Ser. No. 08/650,585 filed May 20, 1996 and U.S. Pat. No. 5,699,477 issued Dec. 16, 1997 entitled "Mixed Excitation Linear Prediction with Fractional Pitch" filed Nov. 9, 1994 of A. McCree are related to the subject application and are incorporated herein by reference.

2. Background of the Invention

Many signals exhibit a slowly-varying, predictable behavior over time, so that changes in the amplitude of the signal are typically small for consecutive time samples. For these signals, quantizers can be developed which are more efficient than simple scalar quantization. For example, a quantization method has previously been proposed in an article by A. McCree and TB Barnwell III entitled "A Mixed Excitation LPC Vocoder Model for Low Bit Rate Speech Coding," IEEE Transactions on Speech Processing, July 1995, pp. 242–250, which reduces the bit rate for quantization of the gain term in Mixed Excitation Linear Predictive (MELP) speech coder.

As described in the above cited article (incorporated herein by reference), the gain term in the MELP coder typically changes slowly with time, except for occasional large excursions at speech transition such as the beginning of a vowel. Therefore, the gain can be quantized more efficiently when grouped into pairs than when each gain is individually quantized. For each pair of consecutive gain terms, the second term is encoded in the traditional way, with a 5-bit (32 level) uniform scalar quantizer covering the entire dynamic range of the gain signal. However, the first term is encoded using only 3 bits (8 levels) and a more limited dynamic range based on the already transmitted values for the second term and the previous value of gain. This method reduces the bit rate of the gain quantization in the MELP coder with no perceivable drop in the quality of the speech signal. This operation is illustrated in FIG. 1 where level 101 represents the level of the first term in the past frame and 102 represents the second term in the past frame. 103 represents the first term in the present frame and 104 represents the level in the second term in the present frame. The second term 102 with 32 levels covers the entire range 10 dB (decibel) to 77 dB, for example. The first term with 3 bits is from 6 dB above the maximum to 6 dB below the minimum of the levels of the neighboring second terms. The actual step size is ⅛th of the range. The step size is dependent on the levels of each frame.

Unfortunately, this quantizer does not perform well in the presence of noisy digital channels. When bit errors are introduced, the decoded value for the second gain term can contain very large errors due to the wide dynamic range of this signal, resulting in annoying "pops" in the output speech.

In accordance with one embodiment of the present invention, applicant presents an improved quantizer which results in better performance for noisy communication channels.

SUMMARY OF THE INVENTION

A method for quantizing a signal and a quantizer is provided by taking advantage of the expected input signal characteristics. In accordance with one embodiment of the present invention an improved quantizer is provided wherein the value of a first term representing a first time period is provided by first encoder and a value of a second term during a second adjacent time period is provided by a second encoder. The quantizer includes an encoder means responsive to a steady state condition to generate a special code. The quantizer includes a decoder with means responsive to the special code to provide an average of decoded second terms for a first term.

These and other features of the invention that will be apparent to those skilled in the art from the following detailed description of the invention, taken together with the accompanying drawings.

DETAILED DESCRIPTION OF ONE EMBODIMENT OF THE PRESENT INVENTION

Human speech consists of a stream of acoustic signals with frequencies ranging up to roughly 20 KHz; however, the band of about 100 Hz to 5 KHz contains the bulk of the acoustic energy. Telephone transmission of human speech originally consisted of conversion of the analog acoustic signal stream into an analog voltage signal stream (e.g., by using a microphone) for transmission and conversion back to an acoustic signal stream (e.g., use a loudspeaker). The electrical signals would be bandpass filtered to retain only the 300 Hz to 4 KHz frequency band to limit bandwidth and avoid low frequency problems. However, the advantages of digital electrical signal transmission has inspired a conversion to digital telephone transmission beginning in the 1960s. Digital telephone signals are typically derived from sampling analog signals at 8 KHz and nonlinearly quantizing the samples with 8 bit codes according to the μ-law (pulse code modulation, or PCM). A clocked digital-to-analog converter and compounding amplifier reconstruct an analog electric signal stream from the stream of 8-bit samples. Such signals require transmission rates of 64 Kbps (kilobits per second) and this exceeds the former analog signal transmission bandwidth.

The storage of speech information in analog format (for example, on magnetic tape in a telephone answering machine) can likewise be replaced with digital storage. However, the memory demands can become overwhelming: 10 minutes of 8-bit PCM sampled at 8 KHz would require about 5 MB (megabytes) of storage.

The demand for lower transmission rates and storage requirements has led to development of compression for speech signals. One approach to speech compression models the physiological generation of speech and thereby reduces the necessary information to be transmitted or stored. In particular, the linear speech production model presumes excitation of a variable filter (which roughly represents the vocal tract) by either a pulse train with pitch period P (for voiced sounds) or white noise (for unvoiced sounds) followed by amplification to adjust the loudness.

Figure 2:
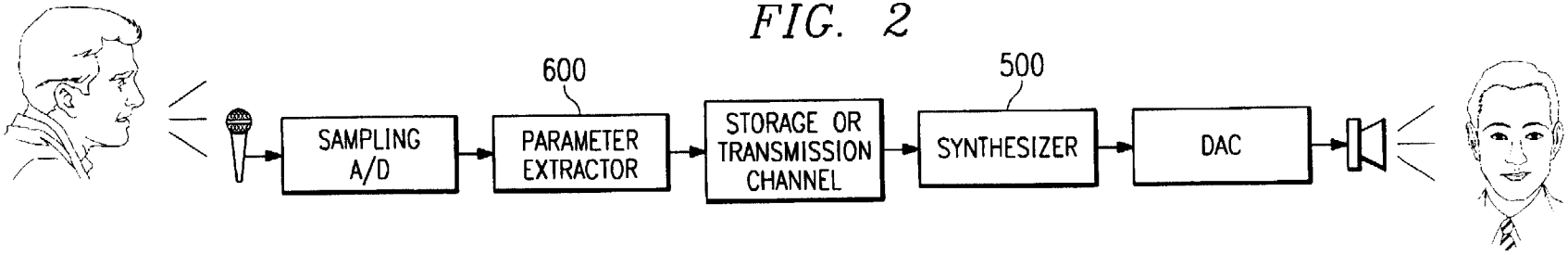
FIG. 2 is a block diagram of a communications system.
Figure 5:
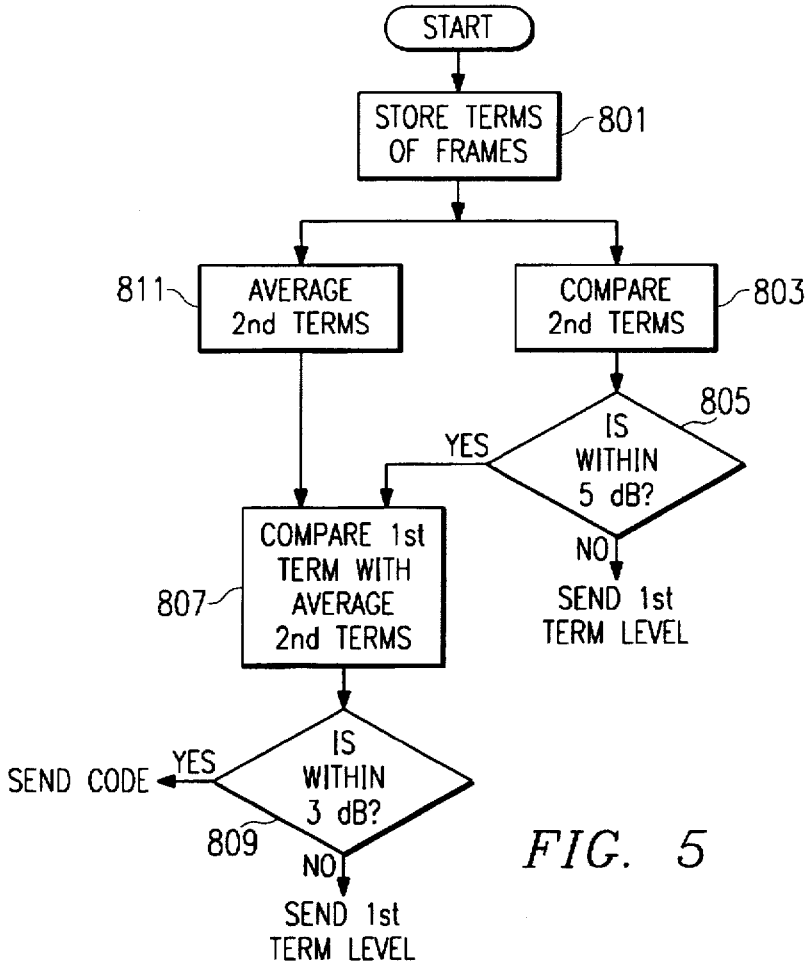
FIG. 5 is a flow chart of the processor operation of FIG. 4.
Figure 7:
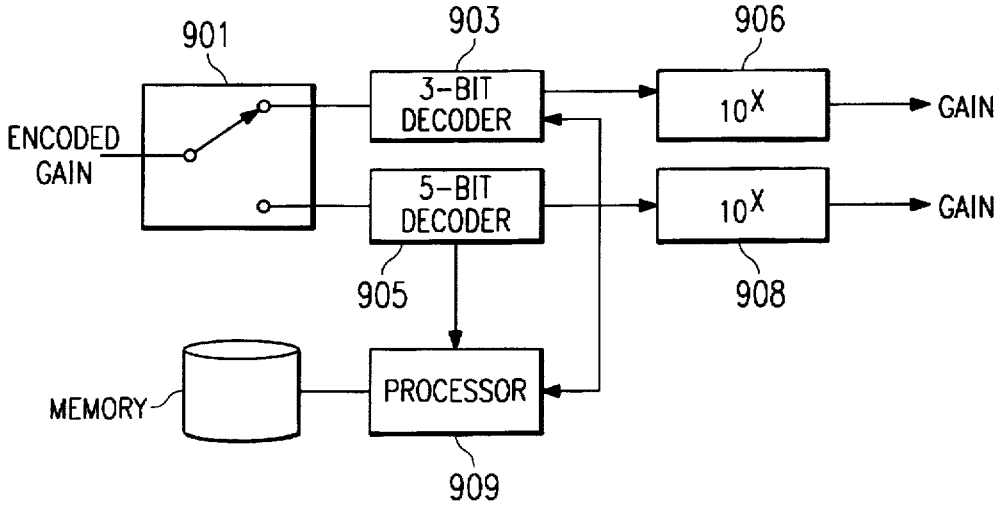
FIG. 7 is a functional diagram of the decoder in the synthesizer of FIG. 6.

The application cited above of A. McCree entitled "Mixed Excitation Linear Prediction with Fractional Pitch" filed Mar. 3, 1994, incorporated herein by reference, is one such low bit rate speech coder. FIG. 7 of that application describes the overall system and is shown herein as FIG. 2. The input speech is sampled by an analog to digital converter and the parameters are encoded in the analyzer 600 and sent via the storage and transmission channel to the synthesizer 500. The decoded signals are then converted back to analog signals by the digital to analog converter for output to a speaker. FIG. 5 of the reference application illustrates the synthesizer. The synthesizer is also illustrated in applicants article in IEEE Trans. on Speech and Audio Processing Vol. 3 ,NO. 4, July 1995 in an article entitled "A mixed Excitation LPC Vocoder Model for Low Bit rate Speech Coding".

Figure 3:
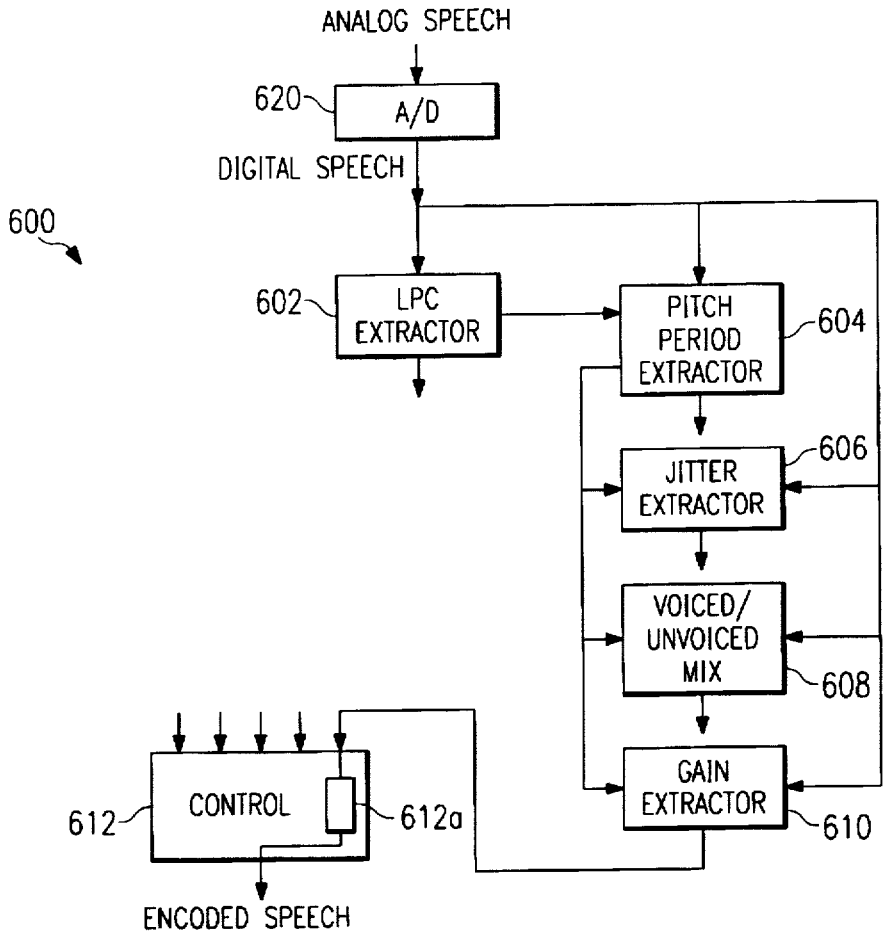
FIG. 3 is a block diagram of an analyzer in the communications system of FIG. 2.

FIG. 3 herein (like FIG. 6 in the above cited application) illustrates the analyzer 600. The analyzer 600 receives the analog speech and converts that to digital speech using analog to digital converter 620. The digitized speech is applied to an LPC extractor 602, pitch period extractor 604, jitter extractor 606, voiced/unvoiced mixture control extractor 608, and gain extractor 610. An encoder(controller) 612 assembles the block outputs and clocks them out as a sample stream. The five arrows into encoder 612 are from the five output blocks. The encoder for gain 610 uses the quantizer system **612*a*** according to the present invention.

Figure 1:
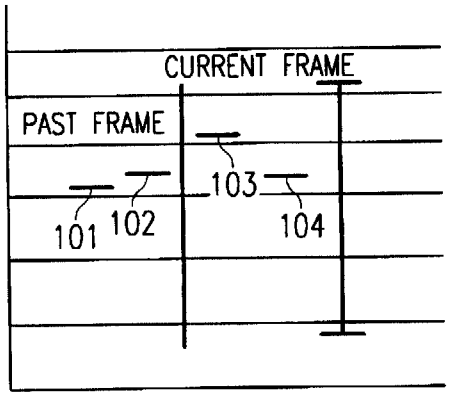
FIG. 1 illustrates frames and first and second terms in frames.

As discussed in the background the encoder provides two output levels each frame. As illustrated in FIG. 1 the level 101 is the first term in the past frame and level 102 is the second term in the past frame. The levels 103 and 104 represent the first and second terms of the present frame. In order to reduce the bit rate of gain quantization the first term is encoder using only three bits and the second term by using five bits. The second term with 32 levels covers the entire range of levels from 10 dB to 77 dB. The first term with only three bits has a range of from 6 dB above the maximum to 6 dB below the minimum of the levels of the neighboring second terms.

As discussed in the background this system does not perform well in the presence of noisy digital channels. When bit errors are introduced, the decoded value for the second gain term can contain very large errors due to the wide dynamic range of this signal. This causes annoying "pops".

Applicants' new quantization method and system herein avoids this problem by taking advantage of the expected steady-state behavior of the gain signal. Typically, the gain does not vary much over the two terms in the current frame and the previous gain term. For these cases, we introduce a special quantization code for the first gain term to represent a steady-state frame. When the decoder in the synthesizer 500 detects the special steady-state code, it simply uses an interpolated value for the first gain term based on the second gain term value and transmitted second and previous gain value. The frames are stored before being transmitted so the second term of the same frame is available for first term calculation. This method improves the performance of the quantizer during steady-state frames under bit errors by introducing redundancy to the transmitted values. For these steady-state frames, the decoder will still produce a steady-state output during bit errors as long as at least some of the information bits are uncorrupted. As long as either the steady-state code or the second gain term is correctly received, the decoder will not introduce significant excursions into the output gain signal. During speech frames which are not steady-state, bit errors will tend to make the decoder of this new quantizer produce a smoother output than was intended. However, steady-state frames occur much more frequently and are more perceptually important than transitional frames, so the performance improvement obtained for the steady-state frames far outweighs any slight quality degradation in bit error performance for transitional frames.

This quantizer has been implemented in a 2.4 kb/s MELP coder, and compared against the previous quantization method. In informal listening tests, the new method provides a clear improvement during bit error conditions, while having no negative effect on clean channel performance.

Figure 4:
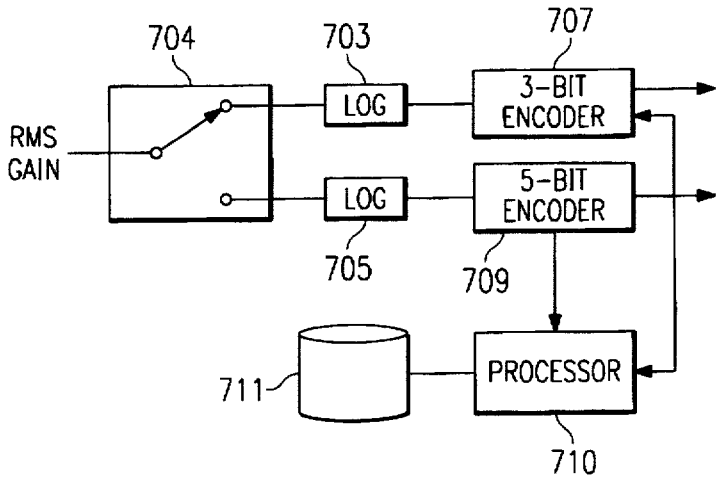
FIG. 4 is a block diagram of the improved quantizer according to one embodiment of the present invention.

Referring to FIG. 4 there is illustrated the encoder portion of the quantizer system according to one embodiment of the present invention. The input speech is converted to digital at A/D converter 620 (FIG. 3) and applied to gain extractor 610. The speech gain is estimated twice per frame using an RMS power level detector of the input speech. For voiced frames the estimation window is adjusted to be a multiple of the pitch period. The gain output from extractor 610 is applied to encoder **612*a*. At encoder 612*a* the converted speech gain over the first half of each frame (first term) is switched via switch 704 to log function detector 703 and over the second half of the frame to log function 705. The log function 703 and 705 may be provided by a log look-up table where for a given gain level a log gain is provided. The output from log function 703 is applied to a 3-bit uniform (equal size step) scalar encoder 707 to provide the first term and the output from log function 705 is applied to 5-bit uniform scalar encoder 709 to provide the second term. The second term is for the whole range from minimum (10 dB for example) to maximum (76 dB the example) in 32 steps as represented by the 5-bits. The encoder 707 is capable of a range of 7 levels with three bits. The first term with only three bits has a range of from 6 dB above the maximum to 6 dB below the minimum of the levels of the neighboring second terms. The eighth possible level is reserved for a special code. A processor 710 is coupled to the 3-bit encoder and 5-bit encoder . The processor is coupled to storage 711. The processor 707** is programmed to follow the procedure of the flow chart of FIG. 5.

The processor stores (steps 801) the terms (gain levels) of the frames in storage 711. The second term of the current frame is compared (step 803) to the second term of the previous frame and the system determines if these two terms have a gain level within 5 dB of the other. If so (yes at step 805), the processor compares (step 807) the value of the first term of the current frame (the intermediate term) to average gain levels of the second terms of the current and previous frames (the halfway point) and if it is within 3 dB of the average gain level (807) then the special steady state code is sent from the 3-bit decoder. The second term (past and current) are averaged at step 811 and sent to comparator 807. If the conditions are not met, the system behaves as before with only seven levels available for the first term since the 8th level is used for the special code.

Figure 6:
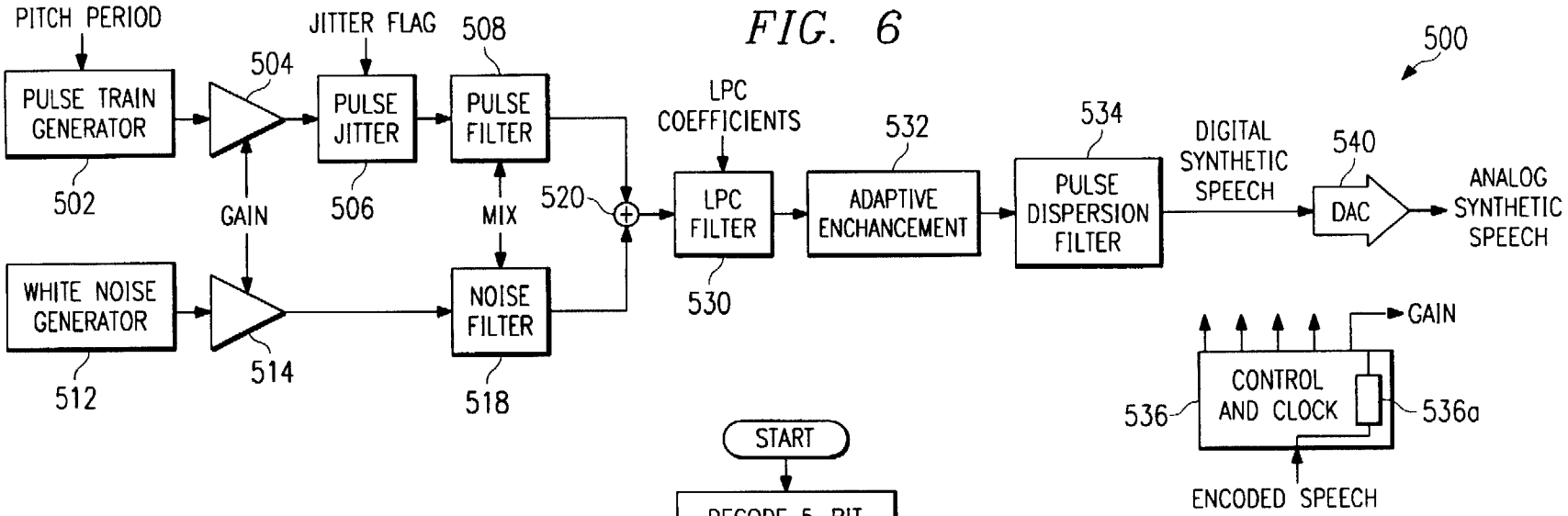
FIG. 6 illustrates a synthesizer in accordance with one embodiment of the present invention.

Referring to FIG. 6 there is illustrated a synthesizer according to one embodiment of the present invention. For the example in the present invention this is the MELP system as shown in FIG. 5 of the above cited application incorporated herein by reference.

FIG. 6 illustrates in functional block form a first preferred embodiment speech synthesizer, generally denoted by reference numeral 500, as including periodic pulse train generator 502 controlled by a pitch period input, a pulse train amplifier 504 controlled by a gain input, pulse jitter generator 506 controlled by a jitter flag input, a pulse filter 508 controlled by five band voiced/unvoiced mixture inputs, white noise generator 512, noise amplifier 514 also controlled by the same gain input, noise filter 518 controlled by the same five band mixture inputs, adder 520 to combine the filtered pulse and noise excitations, linear prediction synthesis filter 530 controlled by 10 LSP inputs, adaptive spectral enhancement filter 532 which adds emphasis to the formants, and pulse dispersion filter 534. Filters 508 and 518 plus adder 520 form a mixer to combine the pulse and noise excitations.

The control signals (LPC coefficients, pitch period, gain, jitter flag, and pulse/noise mixture) derive from analysis of input speech. FIG. 3 illustrated in functional block form a first preferred embodiment speech analyzer, denoted by reference numeral 600, as including LPC extractor 602, pitch period extractor 604, jitter extractor 606, voiced/unvoiced mixture control extractor 608, gain extractor 610, and controller 612 for assembling the block outputs and clocking them out as a sample stream. Sampling analog-to-digital converter 620 could be included to take input analog speech and generate the digital samples at a sampling rate of 8 KHz.

The encoded speech may be received as a serial bit stream and decoded into the various control signals by controller and clock 536. The clock provides for synchronization of the components, and the clock signal may be extracted from the received input bit stream. For each encoded frame transmitted via updating of the control inputs, synthesizer 500 generates a frame of synthesized digital speech which can be converted to frames of analog speech by synchronous digital-to-analog converter 540. Hardware or software or mixed (firmware) may be used to implement synthesizer 500. For example, a digital signal processor such as a TMS320C30 from Texas Instruments can be programmed to perform both the analysis and synthesis of the preferred embodiment functions in essentially real time for a 2400 bit per second encoded speech bit stream. Alternatively, specialized hardware (e.g., ALUs for arithmetic and logic operations with filter coefficients held in ROMs, RAM for holding encoded parameters such as LPC coefficients and pitch, sequences for control, LPC and LSP conversion and back special circuits, a crystal oscillator for clocking, and so forth) which may hardwire some of the operations could be used. Also, a synthesizer alone may be used with stored encoded speech. The encoded speech is applied to control and clock decoder 536 and the five outputs are the gain control, pitch period, extractor, jitter flag, LPC coefficients and voiced/unvoiced mix. The decoding occurs in control and clock decoder 536*a*. For the gain function, the decoder comprises the subsystem of FIG. 7. The encoded input is switched by switch 901 to 3-bit decoder 903 and 5-bit decoder 905 every half frame to provide the first and second terms. The decoder 903 contains, for example, a look-up table that for a 3-bit input term provides a given gain level. The decoder 905 for the 5-bit input term provides a given gain level. An anti-log function of value is calculated at 906 and 908 and provided as gain to the amplifier 504 and 514 in FIG. 6. The anti-log can also be provided by a look-up table. A processor 909 and memory 910 are coupled to the decoder 903 and 905.

Figure 8:
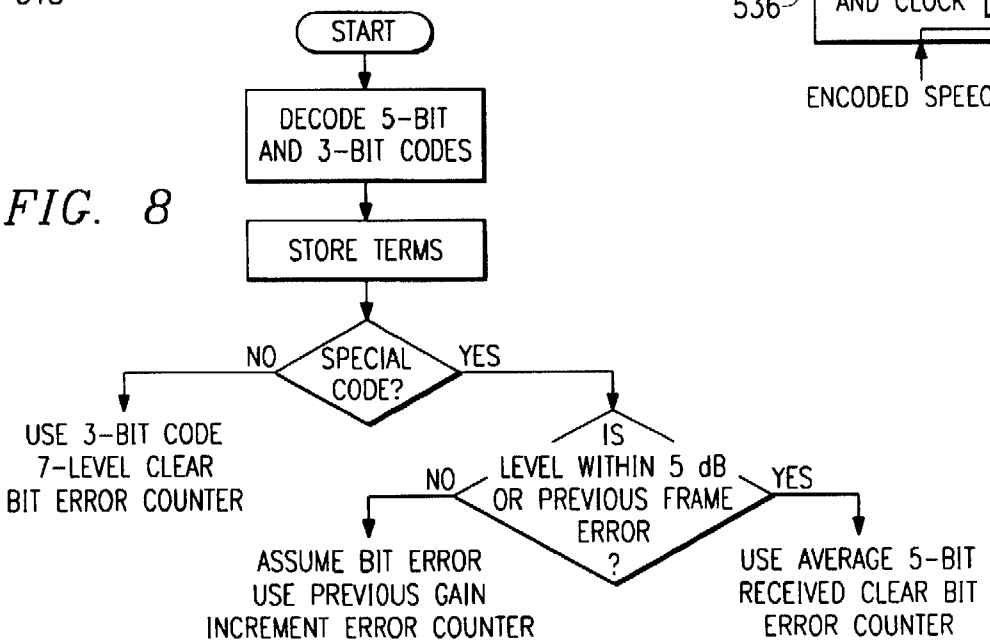
FIG. 8 is a flow diagram for the operation of the decoder of FIG. 7.

The processor 909 stores the current and previous second term gain and averages these gains. The processor looks for the special code and if it does receive the special code as shown in FIG. 8 it averages the value of the received previous and current second gain terms and compares this to the previous gain and if within 5 dB provides the average value to the gain in the synthesizer. If not and if the previous frame was not in error, then it is assumed there was a bit error and a channel error counter is incremented. The previous second frame gain value is repeated for both terms of the current frame. To ensure that the decoder correctly tracks the encoder, the processor does not implement the repeat mechanism if the previous frame was in error.

The pseudo code for the encoder and decoder follows:

```
ENCODER
Code second gain term using 5-bit quantizer
If (second gain within 5 dB of previous value AND
    first gain within 3 dB of interpolated value)
    transmit special interpolation code for first gain
Else
    code first gain with 7 remaining quantizer levels
Endif
DECODER
Decode second gain term
Decode first gain term
If interpolation code received and average of the received and previous
second term gain is within 5 dB from previous second term gain provide
average gain
    If (interpolation code received AND
    second gain more than 5 dB from previous gain AND
    previous frame was not in error)
    assume channel error was introduced to steady-state frame
    increment channel error counter
    repeat previous gain value of second term
    clear channel error counter
Else
    clear channel error counter
Endif
```

Other Embodiments

Although the present invention and its advantages have been described in detail, it should be understood that various changes, substitutions and alterations can be made herein without departing from the spirit and scope of the invention as defined by the appended claims.

What is claimed is:

1. A method of quantizing a signal comprising the steps of:

encoding each frame a first term signal representing an RMS value over a first half of a sampled frame to provide a first encoded signal;

encoding each frame a second term signal representing an RMS value over a second half of a sampled frame to provide a second encoded signal;

generating a special encoded signal representing a steady state condition of said second term signal neighboring said first term signal; and decoding said first encoded signal for a given frame and said second encoded signal for said given frame and a previous frame to said given frame and said special encoded signal to provide for said second decoded signal said second term signal, for said first encoded signal said first term signal unless said special encoded signal is decoded and if said special encoded signal is decoded providing for said first term signal an average signal being the average of said decoded second encoded signals from said given frame and said previous frame.

2. The method of claim 1 wherein said generating step includes the steps of comparing said second term signals in said given frame and in said previous frame, averaging said second term signal values in said given frame and in said previous frame, and if said second term signals in said given frame and said previous frame are within a given range of values comparing said first term signal value to said average of said second term signals in said given frame and said previous frame and if with a second range of values generating said special code.

3. The method of claim 2 wherein said first range is 5 dB and said second range is 3 dB.

4. The method of claim 1 wherein said decoding step includes comparing said second decoded signal from said given frame to said second decoded signal from said previous frame to determine if their values are within a given range and if so providing said average signal and if outside said given range providing a signal indicating a bit error and the further step of providing said second decoded signal from said previous frame for said first and second decoded signal in said given frame when detecting said signal indicating a bit error.

5. A quantizing system comprising:

a first encoder for providing each frame a first encoded signal representing a gain value over a first half of a frame period;

a second encoder for providing each frame a second encoded signal representing a gain value over a second half of a frame;

means responsive to said second encoded signal in a given frame and said second encoded signal from a previous frame previous to said given frame and said first encoded signal in said given frame for determining a steady state condition and means coupled to said determining means for generating a special encoded signal for a finite length of time while determining said steady state condition is occurring; and a first decoder responsive to said first encoded signal for providing a first gain value corresponding to said first encoded signal for said first half of said frame period and a second decoder responsive to said second encoded signal for providing a second gain value corresponding to said second encoded signal for said second half of said frame; and a third decoder responsive to said special encoded signal for providing a third decoded gain value for the first half of the frame in place of said first gain value where said third decoded gain value equals the average of said second decoded gain value received from said second decoder for said given frame and said previous frame.

6. The apparatus of claim 5 wherein said means for generating said special encoded signal comprises means for comparing said second encoded signal from said second encoder in said given frame and said previous frame and if the values of said second encoded signals are within a first range of values comparing the first gain value from said first encoder to the average of values of the encoded signal gain values from the second encoder in said given frame and said previous frame and generating said special encoded signal if the average of the second gain values and first gain value are within a second range.

7. The apparatus of claim 6 wherein said first range is within 5 dB and said second range is 3 dB.

8. The apparatus of claim 5 wherein said third decoder includes means for averaging said second decoder gain values from said second decoder in said given frame and said previous frame to provide an average gain and means for comparing said average gain to said first gain value and providing said average if within a certain range; and said third decoder includes means responsive to said second decoded value from said given frame being greater than said certain range from said second decoded value from said previous frame for providing a signal indicating a bit error.

9. The apparatus of claim 8 wherein said certain range is within 5 dB.

10. The apparatus of claim 9 wherein said third decoder includes means responsive to said average not being within 5 dB providing a signal indicating a bit error; and wherein said system includes means responsive to said signal indicating bit error for providing said second decoded signal from said previous frame for said first and second decoded signal in said given frame.

11. A low bit rate speech communications system comprising:

an analog to digital converter responsive to audio speech signals for providing digital signals representing samples of analog signals;

an encoder responsive to said digital signals for encoding speech information to provide over a communications channel, said encoder comprising a first encoder for providing each frame a first encoded signal representing a first gain value over a first half of a frame period;

a second encoder for providing each frame a second encoded signal representing a second gain value over a second half of a frame;

means responsive to said second encoded signal at a given frame and a frame previous to said given frame and said first encoded signal for determining a steady state conditions means coupled to said determining means for generating a special encoded signal for a finite length of time while determining said steady state condition is occurring;

a communications channel coupled to said encoder for transmitting said first encoded signal and said second encoded signal;

a synthesizer coupled to said channel and responsive to said first encoded signal and said second encoded signal for providing digital synthetic speech; said synthesizer including:

a first decoder coupled to said channel and responsive to said first encoded signal for providing a first decoded gain value corresponding to said first encoded signal for said first half of said frame period;

a second decoder coupled to said channel and responsive to said second encoded signal for providing a second decoded gain value corresponding to said second encoded signal for said second half of said frame; and a third decoder coupled to said channel and responsive to said special encoded signal for providing an averaged gain value for the first half of the frame in place of said first decoder output where the average gain value is equal to the average of said second decoded gain value of said given frame and second gain value of said frame previous to said given frame from said second decoder.

12. The low bit rate communications system of claim 11 wherein said means for determining a steady state condition comprises means for comparing said second decoded gain values from said second encoder from said given frame and previous frame and if the values are within a first range of values from said first decoder for said given frame comparing the first decoded gain value from said first encoder for said given frame to the average gain value of the encoded second gain values from the second encoder and said means for generating includes means for generating said special encoded signal if the values are within a second range.

13. The low bit rate communications system of claim 12 wherein said first range is within 5 dB and said second range is 3 dB.

14. The apparatus of claim 11 wherein third decoder includes means for averaging said second decoded gain values from said second decoder in said given frame and previous frame to provide an average value and means for comparing said average value to said first gain value in said given frame and providing said average if within a certain range.

15. The apparatus of claim 14 wherein said range is within 5 dB.

16. The apparatus of claim 15 wherein said third decoder includes means responsive to said average value not being within 5 dB providing a signal indicating a bit error.

17. A method of communicating signals comprising the steps of:

sampling and analyzing said signals over a frame period of time to provide each frame a first term signal and a second term signal representing an RMS value over a first and second half of said frame;

encoding each frame said first term signal representing an RMS value over a first half of a sampled frame to provide a first encoded signal;

encoding each frame said second term signal representing an RMS value over a second half of a sampled frame to provide a second encoded signal;

generating a special encoded signal representing a steady state condition of second term signal in a given frame and said second term signal in a previous frame before said given frame;

transmitting said encoded first and second encoded signals and said special encoded signals over a communications channel;

decoding said first and second encoded signals and said special encoded signal to provide for said second encoded signal said second term signal, for said first encoded signal said first term signal unless said special encoded signal is decoded and if said special code signal is decoded providing for said first term signal an average signal being the average of said decoded second encoded signals from said given frame and said previous frame; and synthesizing and converting said first and said term signals and said average signal to provide a synthesized representation of said signals analyzed and sampled.

18. The method of claim 17 wherein said decoding step includes comparing said average signal to said first term signal to determine if within a given value range and if so providing said average signal and if outside said given value range providing an error signal.

19. The method of claim 18 wherein said generating step includes the steps of comparing said second term signal in said given frame and previous frame and said first term signal, averaging said second term signal from said given frame and previous frame to get an average value, and if said second term signal from said given frame and said second term signal from said previous frame are within a first range of each other comparing said first term signal to said average value of said second term signals and if within a second range generating said special code.

20. The method of claim 19 wherein said first range is 5 dB and said second range is 3 dB.

21. A quantizing system comprising:

a first encoder for providing each frame a first encoded signal representing a value over a first time period;

a second encoder for providing each frame a second encoded signal representing a value over a second adjacent time period;

determining means responsive to said second encoded signal in a given frame and said second encoded signal in a previous frame previous to said given frame and said first encoded signal in said given frame for determining a steady state condition, means coupled to said determining means for generating a special encoded signal when said determining means determines said steady state condition; a first decoder responsive to said first encoded signal for providing a first decoded value corresponding to said first encoded signal for said first time period and a second decoder responsive to said second encoded signal for providing a second decoded value corresponding to said second encoded signal for said second time period;

a third decoder responsive to said special encoded signal for providing a third decode value for said first time period in place of an output from said first decoder where said third decoded value equals an average of said second decoded value from said given frame and said previous frame from said second decoder; and said third decoder includes means responsive to said special encoded signal and said second decoded value from said given frame being significantly different from said second decoded value from said previous frame to provide a signal indicating a bit error.

22. The system of claim 1 including means responsive to said signal indicating a bit error for providing said second decoded signal from said previous frame for said first and second decoded signals in said given frame.

* * * * *